US012735770B2

(12) United States Patent
Iwashita et al.

(10) Patent No.: US 12,735,770 B2
(45) Date of Patent: Sep. 15, 2026

(54) THIXOTROPIC MOLDING MATERIAL, METHOD OF PRODUCING THIXOTROPIC MOLDING MATERIAL, AND THIXOTROPICALLY MOLDED PRODUCT

(71) Applicant: SEIKO EPSON CORPORATION, Tokyo (JP)

(72) Inventors: Setsuya Iwashita, Nirasaki (JP); Tetsuhiko Takeuchi, Shimosuwa (JP); Yasutoshi Hideshima, Matsumoto (JP); Fumiya Maeda, Matsumoto (JP); Shunsuke Uchizono, Shiojiri (JP); Koichi Ozaki, Okayama (JP); Tadao Fukuta, Kurashiki (JP)

(73) Assignee: SEIKO EPSON CORPORATION (JP)

( * ) Notice: Subject to any disclaimer, the term of this patent is extended or adjusted under 35 U.S.C. 154(b) by 435 days.

(21) Appl. No.: 18/396,876

(22) Filed: Dec. 27, 2023

(65) Prior Publication Data

US 2024/0218484 A1 Jul. 4, 2024

(30) Foreign Application Priority Data

Dec. 28, 2022 (JP) ..... 2022-211888

(51) Int. Cl.

| | |
|---|---|
| ***C22C 1/10*** | (2023.01) |
| ***C22C 32/00*** | (2006.01) |
| ***C23C 24/10*** | (2006.01) |

(52) U.S. Cl.

CPC ..... *C22C 1/1089* (2023.01); *C22C 32/0047* (2013.01); *C23C 24/103* (2013.01)

(58) Field of Classification Search

CPC ..... C22C 23/02; C22C 23/00; C22C 32/0005; C22C 1/10; C22C 32/0047; C22C 1/1089; C23C 24/103; B22F 1/05; B22F 1/06; B22F 1/16; B22F 3/225; B22F 1/068; B22F 1/102; B22F 1/105; B22F 1/1047

See application file for complete search history.

(56) References Cited

U.S. PATENT DOCUMENTS

2021/0291262 A1 9/2021 Ozaki et al.

FOREIGN PATENT DOCUMENTS

| | | | |
|---|---|---|---|
| CN | 101148723 | A | 3/2008 |
| JP | 2021-147681 | A | 9/2021 |

OTHER PUBLICATIONS

Bruls, R. J., et al. "Preparation, characterization and properties of MgSiN2 ceramics." Journal of Materials Science: Materials in Electronics 13.2 (2002): 63-75.*

* cited by examiner

*Primary Examiner* — Jessee R Roe

(74) *Attorney, Agent, or Firm* — Harness, Dickey & Pierce, P.L.C.

(57) ABSTRACT

A thixotropic molding material includes: a metal body containing Mg as a main component; AlN particles adhering to a surface of the metal body and containing AlN as a main component; and silica particles interposed between the metal body and the AlN particles, having an average particle diameter smaller than an average particle diameter of the AlN particles, and containing a silicon oxide as a main component. A mass fraction of the AlN particles in a total mass of the metal body and the AlN particles is 3.0% or more and 30.0% or less.

11 Claims, 5 Drawing Sheets

THIXOTROPIC MOLDING MATERIAL, METHOD OF PRODUCING THIXOTROPIC MOLDING MATERIAL, AND THIXOTROPICALLY MOLDED PRODUCT

The present application is based on, and claims priority from JP Application Serial Number 2022-211888, filed Dec. 28, 2022, the disclosure of which is hereby incorporated by reference herein in its entirety.

BACKGROUND

1. Technical Field

The present disclosure relates to a thixotropic molding material, a method of producing a thixotropic molding material, and a thixotropically molded product.

2. Related Art

Magnesium has properties of a low specific gravity and good electromagnetic wave shielding properties, good vibration damping capability, good machinability, and good biosafety. Based on such a background, magnesium alloy components are beginning to be used in products such as automobile components, aircraft components, mobile phones, and notebook computers.

For example, Chinese Patent Application Publication No. 101148723 discloses a magnesium-based composite material in which a content of a magnesium-based alloy is 80 wt % to 95 wt % and a content of AlN ceramic granules is 5 wt % to 20 wt %.

The magnesium-based composite material is produced by a casting method. Specifically, an $Mg_3N_2$ powder covered with an aluminum foil is pressed into a molten Mg—Al alloy, then the $Mg_3N_2$ powder and aluminum are reacted in the molten Mg—Al alloy while maintaining a temperature, and then the molten Mg—Al alloy is cast in a metal mold. The obtained magnesium-based composite material has characteristics such as a light weight, high strength, and high elasticity.

In the magnesium-based composite material described in Chinese Patent Application Publication No. 101148723, the AlN ceramic granules act as a reinforcing material. However, in a production method described in Chinese Patent Application Publication No. 101148723, the molten Mg—Al alloy cannot be uniformly mixed with the aluminum foil or the $Mg_3N_2$ powder. Therefore, dispersibility of the Al ceramic granules obtained during a production process is low. As a result, uniformity of the magnesium-based composite material may decrease, and mechanical strength cannot be sufficiently increased.

SUMMARY

A thixotropic molding material according to an application example of the present disclosure includes: a metal body containing Mg as a main component; AlN particles adhering to a surface of the metal body and containing AlN as a main component; and silica particles interposed between the metal body and the AlN particles, having an average particle diameter smaller than an average particle diameter of the AlN particles, and containing a silicon oxide as a main component. A mass fraction of the AlN particles in a total mass of the metal body and the AlN particles is 3.0% or more and 30.0% or less.

A method of producing a thixotropic molding material according to an application example of the present disclosure includes: a preparation step of preparing a mixture containing a metal body containing Mg as a main component, AlN particles containing AlN, silica particles, and a dispersion medium; a stirring step of stirring the mixture; and a drying step of adhering the AlN particles to a surface of the metal body via the silica particles by removing at least a part of the dispersion medium from the stirred mixture.

A thixotropically molded product according to an application example of the present disclosure includes: a matrix portion containing Mg as a main component; a first particle portion dispersed in the matrix portion and containing AlN as a main component; a second particle portion dispersed in the matrix portion and containing $Mg_2Si$ as a main component; and a third particle portion dispersed in the matrix portion and containing MgO as a main component. An area fraction of the first particle portion in a cross section is 1.6% or more and 18.1% or less.

DESCRIPTION OF EMBODIMENTS

Hereinafter, a thixotropic molding material, a method of producing a thixotropic molding material, and a thixotropically molded product according to the present disclosure will be described in detail based on embodiments shown in the accompanying drawings.

1. Thixotropic Molding Method

First, an example of a thixotropic molding method of producing a thixotropically molded product will be described.

The thixotropic molding method is a molding method in which a pellet-shaped or chip-shaped raw material is heated in a cylinder to bring the material into a solid-liquid coexistence state in which a liquid phase and a solid phase coexist, then thixotropy is developed by rotation of a screw, and the obtained semi-solidified product is injected into a mold. According to such a thixotropic molding method, since fluidity of the semi-solidified product is enhanced by heating and shearing, a thin component or a component having a complicated shape can be formed as compared with, for example, a die casting method.

Figure 1:
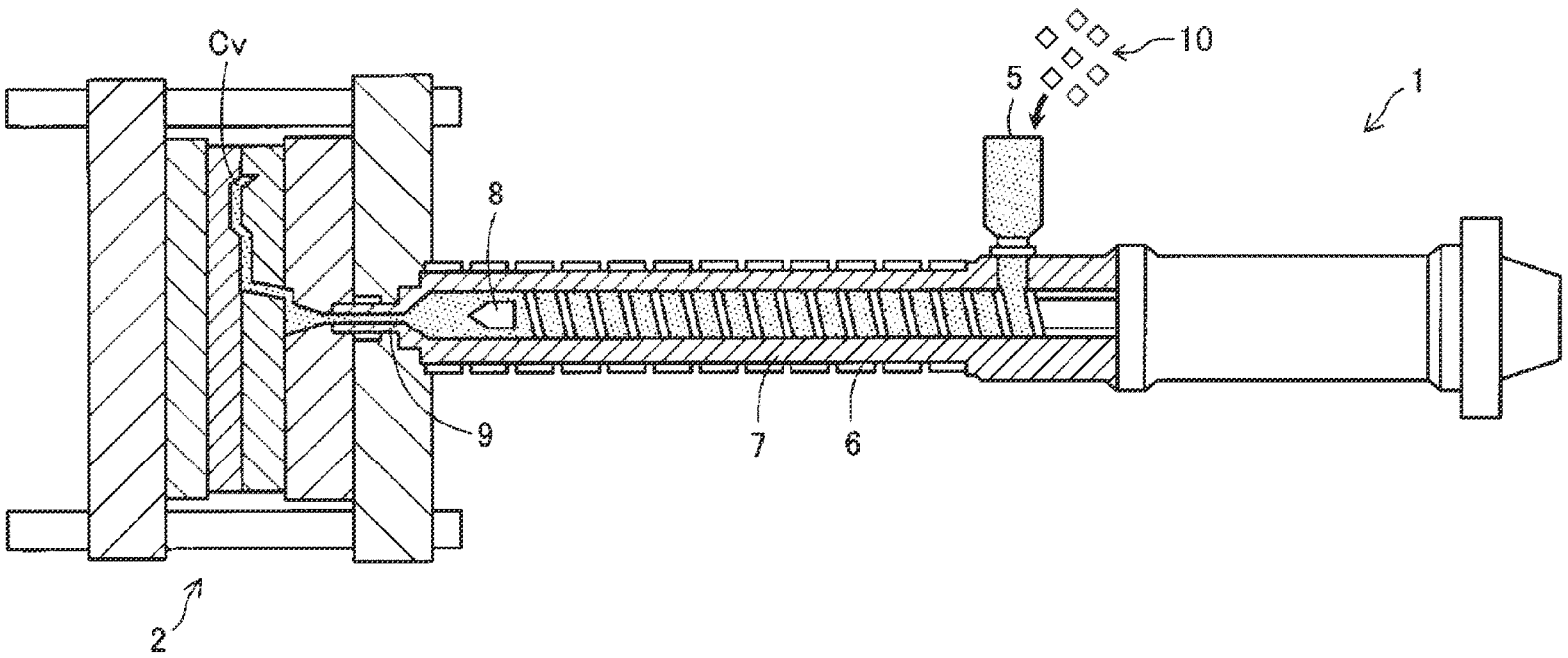
FIG. 1 is a cross-sectional view showing an example of an injection molding machine used in a thixotropic molding method.

FIG. 1 is a cross-sectional view showing an example of an injection molding machine used for the thixotropic molding method.

As shown in FIG. 1, an injection molding machine 1 includes a mold 2, a hopper 5, a heating cylinder 7, a screw 8, and a nozzle 9. A cavity Cv is formed in the mold 2. When a thixotropic molding material 10 is charged into the hopper 5, the thixotropic molding material 10 is supplied to the heating cylinder 7. The thixotropic molding material 10 supplied to the heating cylinder 7 is heated by a heater 6 and conveyed while being sheared by the screw 8. Accordingly, the thixotropic molding material 10 is semi-melted and slurried. The obtained slurry is injected into the cavity Cv in the mold 2 through the nozzle 9 without being exposed to the atmosphere. Then, the slurry injected into the cavity Cv is cooled to obtain a thixotropically molded product.

A material containing magnesium as a main component is used as the thixotropic molding material 10. The hopper 5 may be charged with other materials together with the thixotropic molding material 10.

2. First Embodiment

Next, a thixotropic molding material according to a first embodiment will be described.

Figure 2:
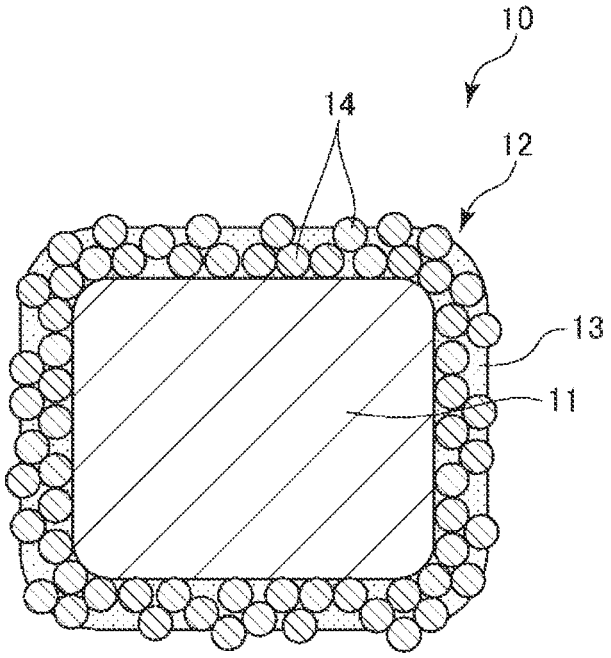
FIG. 2 is a cross-sectional view schematically showing a thixotropic molding material according to a first embodiment.
Figure 3:
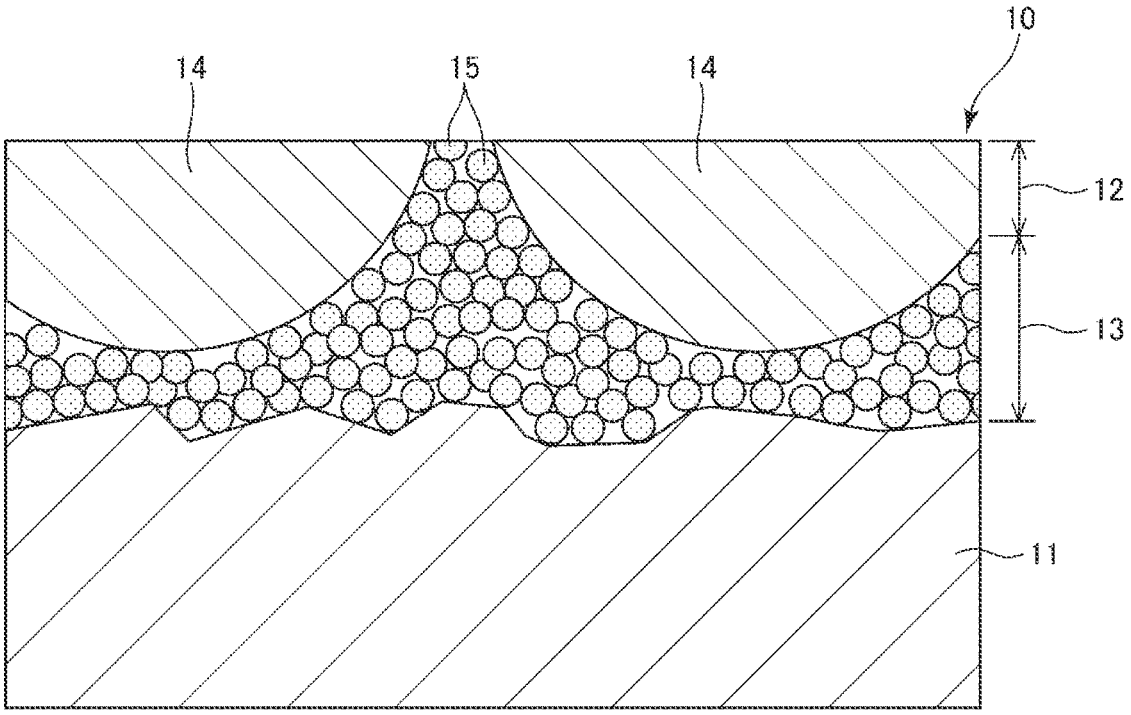
FIG. 3 is a partially enlarged view of FIG. 2.

FIG. 2 is a cross-sectional view schematically showing the thixotropic molding material 10 according to the first embodiment. FIG. 3 is a partially enlarged view of FIG. 2.

The thixotropic molding material 10 shown in FIG. 2 includes a chip-shaped metal body 11, a coating portion 12 provided on a surface of the metal body 11, and a bonding portion 13 interposed between the metal body 11 and the coating portion 12.

The metal body 11 contains Mg as a main component. As shown in FIG. 2, the coating portion 12 includes a plurality of AlN particles 14. The AlN particles 14 are provided on the surface of the metal body 11. The AlN particles 14 contain AlN (aluminum nitride) as a main component.

As shown in FIG. 3, the bonding portion 13 includes a plurality of silica particles 15. The bonding portion 13 penetrates between the metal body 11 and the AlN particles 14 and between the AlN particles 14, and acts to bond them.

By performing thixotropic molding using such a thixotropic molding material 10, falling off of the AlN particles 14 is prevented by an action of the bonding portion 13. Therefore, a semi-molten material of the metal body 11 and the AlN particles 14 are likely to be uniformly mixed in the heating cylinder 7. Accordingly, the AlN particles 14 are uniformly dispersed in the semi-molten material. As a result, a thixotropically molded product in which AlN dispersed in a matrix portion is uniformly distributed can be produced.

The AlN particles 14 have a high thermal conductivity and a high elastic modulus derived from AlN. Therefore, the thixotropically molded product in which AlN is distributed is imparted with high mechanical strength and a high thermal conductivity in addition to high specific rigidity derived from Mg. In addition, the specific rigidity of the thixotropically molded product can be further enhanced.

The silica particles 15 act to enhance wettability between the AlN particles 14 and the semi-molten material of the metal body 11 during the thixotropic molding. Accordingly, in the produced thixotropically molded product, affinity and adhesion between a site derived from the AlN particles 14 and a site derived from the metal body 11 can be enhanced. As a result, it is possible to produce a thixotropically molded product which is denser and has enhanced mechanical strength and thermal conductivity.

A mass fraction of the AlN particles 14 in a total mass of the metal body 11 and the AlN particles 14 is 3.0% or more and 30.0% or less. By setting the mass fraction of the AlN particles 14 within the above range, a ratio of the site derived from the metal body 11 to the site derived from the AlN particles 14 can be optimized in the produced thixotropically molded product. Accordingly, in the thixotropically molded product, both the characteristics derived from Mg and the characteristics derived from AlN can be achieved.

2.1. Metal Body

The metal body 11 is, for example, a section obtained by machining or cutting an Mg-based alloy cast with a mold or the like. A method of producing the metal body 11 is not limited thereto.

A material containing Mg as a main component is used as a constituent material of the metal body 11. Containing Mg as a main component refers to that, when elemental analysis is performed on the metal body 11, a content of Mg is the highest in terms of atomic ratio. For the elemental analysis, for example, a qualitative and quantitative analysis based on an energy dispersive X-ray spectroscopy (EDX) is used. The content of Mg in the metal body 11 may be higher than that of other elements, and is preferably more than 50 atomic %, more preferably 70 atomic % or more, and still more preferably 80 atomic % or more.

The metal body 11 may contain various additive components other than Mg. Examples of the additive components include lithium, beryllium, calcium, aluminum, silicon, manganese, iron, nickel, copper, zinc, strontium, yttrium, zirconium, silver, tin, gold, and rare earth elements, and one or a mixture of two or more of these components is used. Examples of the rare earth elements include cerium.

In particular, the additive component preferably contains both aluminum and zinc. Accordingly, a melting point of the thixotropic molding material 10 decreases, and fluidity of the semi-solidified product is improved. As a result, moldability during the thixotropic molding is enhanced, and thus dimensional accuracy of the produced thixotropically molded product can be enhanced. A content of aluminum in the metal body 11 is, for example, preferably 5.0 mass % or more and 13.0 mass % or less, and more preferably 7.0 mass % or more and 11.0 mass % or less. A content of zinc in the metal body 11 is, for example, preferably 0.3 mass % or more and 3.0 mass % or less, and more preferably 0.5 mass % or more and 2.0 mass % or less.

In addition to aluminum and zinc, the additive component preferably contains at least one selected from the group consisting of silicon, manganese, yttrium, strontium, and rare earth elements. Accordingly, mechanical properties, corrosion resistance, wear resistance, and thermal conductivity of the thixotropically molded product can be enhanced.

A composition of the metal body 11 may be a composition of a magnesium alloy defined in various standards. Examples of such a magnesium alloy include AZ91A, AZ91B, AZ91D, AM60A, AM60B, AS41A, AZ31, AZ31B, AZ61A, AZ63A, AZ80A, AZ91C, AZ91E, AZ92A, AM100A, ZK51A, ZK60A, ZK61A, EZ33A, QE22A, ZE41A, MIA, WE54A, and WE43B of the American Society for Testing and Materials (ASTM) standard. Among these, AZ91A, AZ91B, or AZ91D are preferably used. These magnesium alloys are useful because of well-balanced moldability, mechanical properties, and the like, and are excellent in corrosion resistance.

The additive component may be present in a form of a simple substance, an alloy, an oxide, an intermetallic compound, and the like in the metal body 11. The additive component may be segregated or uniformly dispersed in a crystal grain boundary of a metal structure such as Mg or an Mg alloy in the metal body 11.

An average particle diameter of the metal body 11 is not particularly limited, and is preferably 0.5 mm or more, and more preferably 1.5 mm or more and 10.0 mm or less. By setting the average particle diameter within the above range, generation of bridges and the like in the heating cylinder 7 of the injection molding machine 1 can be prevented.

The average particle diameter of the metal body 11 is an average value of diameters of circles having an area same as a projected area of the metal body 11. The average value is calculated based on 100 or more randomly selected metal bodies 11.

An average aspect ratio of the metal body 11 is preferably 5.0 or less, and more preferably 4.0 or less. In the metal body 11 having such an average aspect ratio, a filling property in the heating cylinder 7 is enhanced and temperature uniformity during heating is improved. As a result, a thixotropically molded product having high mechanical properties and high dimensional accuracy can be obtained.

The average aspect ratio of the metal body 11 is an average value of aspect ratios calculated from major axis/minor axis in a projection image of the metal body 11. The average value is calculated based on 100 or more randomly selected metal bodies 11. The major axis is a maximum length that can be taken in the projection image, and the minor axis is a maximum length in a direction orthogonal to the major axis.

The metal body 11 may be subjected to any surface treatment as necessary. Examples of the surface treatment include a plasma treatment, a corona treatment, an ozone treatment, an ultraviolet irradiation treatment, and a roughening treatment.

2.2. Coating Portion

The coating portion 12 includes the plurality of AlN particles 14. In the embodiment, as shown in FIG. 2, the plurality of AlN particles 14 are distributed to cover the surface of the metal body 11, thereby forming the coating portion 12. The coating portion 12 preferably covers the entire surface of the metal body 11, or may cover only a part of the surface.

The AlN particles 14 are dispersed in the semi-molten material when subjected to the thixotropic molding. The AlN particles 14 are less likely to vaporize during the thixotropic molding, and can be prevented from causing molding defects.

The AlN particles 14 contain AlN as a main component. Containing AlN as a main component refers to that, when the elemental analysis is performed on the AlN particles 14, a content of one of Al and N is the highest and a content of the other is the second highest in terms of atomic ratio. For the elemental analysis, for example, a qualitative and quantitative analysis based on an energy dispersive X-ray spectroscopy (EDX) is used. A total content of Al and N in the AlN particles 14 may be higher than that of other elements, and is preferably more than 50 atomic %, and more preferably 60 atomic % or more.

An average particle diameter of the AlN particles 14 is preferably 50 μm or less, more preferably 0.5 μm or more and 20 μm or less, and still more preferably 1 μm or more and 10 μm or less. By setting the average particle diameter of the AlN particles 14 within the above range, when the AlN particles 14 adhere to the surface of the metal body 11, the AlN particles 14 can be uniformly distributed, and the AlN particles 14 are less likely to fall off.

When the average particle diameter of the AlN particles 14 is less than the above lower limit value, the particle diameter of the AlN particles 14 is too small, and thus the AlN particles 14 may be less likely to function as a reinforcing material that enhances mechanical properties of the thixotropically molded product. On the other hand, when the average particle diameter of the AlN particles 14 is more than the above upper limit value, the AlN particles 14 may be likely to fall off.

Figure 4:
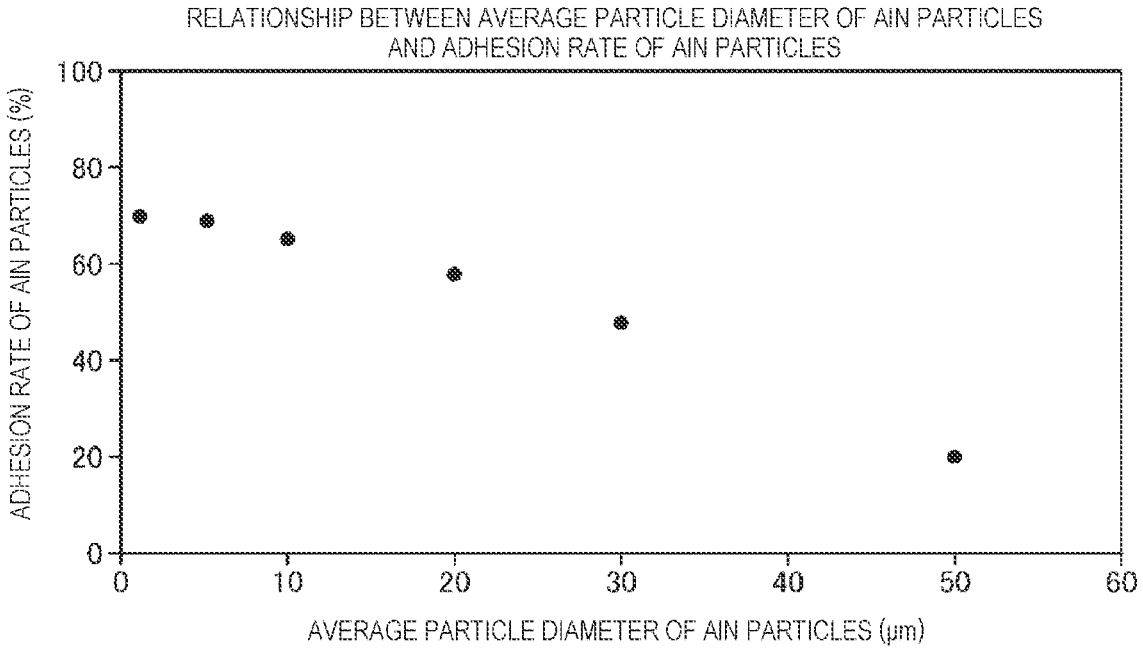
FIG. 4 is a graph showing a relationship between an average particle diameter of AlN particles and a proportion of the AlN particles adhering to a metal body (adhesion rate of AlN particles).

FIG. 4 is a graph showing a relationship between an average particle diameter of the AlN particles 14 and a proportion of the AlN particles 14 adhering to the metal body 11 (adhesion rate of the AlN particles 14). When the adhesion rate of the AlN particles 14 is high, the AlN particles 14 are less likely to fall off from the thixotropic molding material 10, and thus stability of the thixotropic molding material 10 is enhanced.

As shown in FIG. 4, when the average particle diameter of the AlN particles 14 increases, the adhesion rate of the AlN particles 14 tends to decrease. When the average particle diameter is 50 μm or less, the adhesion rate of about 20% can be secured. In addition, when the average particle diameter is 20 μm or less, the adhesion rate of 50% or more can be secured. Therefore, setting the average particle diameter of the AlN particles 14 within the above range is useful from the viewpoint of implementing the stable thixotropic molding material 10.

The average particle diameter of the AlN particles 14 is a value obtained by measuring the particle diameters of the AlN particles 14 from an observation image of the AlN particles 14 magnified and observed with a microscope and averaging 100 or more pieces of measurement data. As the microscope, for example, a scanning electron microscope or an optical microscope is preferably used. The particle diameters of the AlN particles 14 are intermediate values between a length of the major axis and a length of the minor axis in the observation image of the AlN particles 14.

As described above, the mass fraction of the AlN particles 14 in the total mass of the metal body 11 and the AlN particles 14 is 3.0% or more and 30.0% or less. Accordingly, since the mass fraction of the AlN particles 14 is optimized, a thixotropically molded product having high mechanical strength and high thermal conductivity in addition to high specific rigidity derived from Mg is obtained. In addition, high specific rigidity derived from Mg can be further enhanced. The mass fraction of the AlN particles 14 is preferably 5.0% or more and 25.0% or less, and more preferably 7.0% or more and 20.0% or less.

The coating portion 12 may contain a substance other than the AlN particles 14. In this case, a content of the substance other than the AlN particles 14 may be less than the content of the AlN particles 14 in terms of mass ratio, and is preferably 30 mass % or less, and more preferably 10 mass % or less of the AlN particles 14.

The AlN particles 14 may be subjected to any surface treatment as necessary. Examples of the surface treatment include a plasma treatment, a corona treatment, an ozone treatment, an ultraviolet irradiation treatment, a roughening treatment, and a coupling agent treatment.

A method of producing the AlN particles 14 is not particularly limited. Examples of the method of producing the AlN particles 14 include an alumina reduction nitriding method in which alumina is nitrided in the presence of carbon, a direct nitriding method in which aluminum and nitrogen are directly reacted, and a gas phase method in which alkyl aluminum and ammonia are reacted and then heated. Among these, a powder produced by the alumina reduction nitriding method is preferably used for the AlN particles 14. The AlN particles 14 produced by the alumina reduction nitriding method have a small change in weight when heated as compared with powders produced by other production methods, thereby enabling stable thixotropic molding. That is, generation of gas causing a change in weight is small, and a change in pressure during molding can be reduced to be small.

When the AlN particles 14 are subjected to thermogravimetric analysis in which the temperature is increased from room temperature at a temperature increase rate of 10° C./min, a weight loss rate at 300° C. is preferably 0.3% or less, and more preferably 0.2% or less. When the weight loss rate of the AlN particles 14 is within the above range, the generation of gas during the thixotropic molding is sufficiently reduced. Accordingly, the thixotropic molding material 10 that enables stable thixotropic molding is obtained. As a result, a denser thixotropically molded product is obtained.

2.3. Bonding Portion

The bonding portion 13 includes the silica particles 15 in the form of particles. As shown in FIG. 3, the silica particles 15 penetrate between the metal body 11 and the AlN particles 14 and between the AlN particles 14, and act to bond them.

The silica particles 15 have an average particle diameter smaller than the average particle diameter of the AlN particles 14 and contain a silicon oxide as a main component. In the present specification, the "silicon oxide" refers to a substance represented by a composition formula of $SiO_x$ ($0<x\leq 2$). Since such silica particles 15 are minute, the silica particles 15 easily enter between the metal body 11 and the AlN particles 14 or between the AlN particles 14. It is considered that the silica particles 15 strongly interact with both the metal body 11 and the AlN particles 14 since the silica particles 15 have a very large specific surface area. Examples of the interaction include an intermolecular force such as a hydrogen bond and a Van Der Waals force, and an anchor effect caused by an aggregate of the silica particles 15 entering irregularities present on the surface of the metal body 11. In particular, hydroxy groups are present in a high density on surfaces of the silica particles 15 containing the silicon oxide. The hydroxy group forms a hydrogen bond with the metal body 11 and the AlN particles 14, which is considered to be a driving force for the interaction. Due to such interaction, the bonding portion 13 has a function of fixing the AlN particles 14 to the surface of the metal body 11.

In the thixotropic molding material 10 including such a bonding portion 13, the AlN particles 14 are less likely to fall off because the metal body 11 and the AlN particles 14 are more firmly fixed to each other via the silica particles 15. Therefore, when the thixotropic molding material 10 is charged into the heating cylinder 7 during the thixotropic molding, the semi-molten material of the metal body 11 and the AlN particles 14 are likely to be uniformly mixed. Accordingly, the AlN particles 14 and the silica particles 15 can be uniformly dispersed in the thixotropically molded product.

The silicon oxide contained in the silica particles 15 is less likely to be vaporized, and functions as a reinforcing material that reinforces the mechanical properties of the thixotropically molded product in combination with magnesium when incorporated into the thixotropically molded product. Therefore, by using the silica particles 15 containing the silicon oxide, it is possible to obtain the thixotropic molding material 10 with which a thixotropically molded product having excellent mechanical properties while preventing the occurrence of molding defects due to the vaporization can be produced.

In addition, the silicon oxide acts to enhance the wettability between the AlN particles 14 and the semi-molten material of the metal body 11 during the thixotropic molding. That is, since the silica particles 15 are present adjacent to the AlN particles 14 in the thixotropic molding material 10, the silica particles 15 are interposed between the AlN particles 14 and the metal body 11, thereby enhancing the affinity therebetween. Accordingly, in the produced thixotropically molded product, adhesion between a site derived from the AlN particles 14 and a site derived from the metal body 11 can be enhanced. As a result, it is possible to produce a thixotropically molded product which is denser and has enhanced mechanical strength and thermal conductivity.

Containing the silicon oxide as a main component refers to that, when the elemental analysis is performed on the silica particles 15, a content of one of Si and O is the highest and a content of the other is the second highest in terms of atomic ratio. For the elemental analysis, for example, a qualitative and quantitative analysis based on an energy dispersive X-ray spectroscopy (EDX) is used. A total content of Si and O in the silica particles 15 may be higher than that of other elements, and is preferably more than 50 atomic %, more preferably 60 atomic % or more, and still more preferably 80 atomic % or more.

The silica particles 15 may contain impurities in addition to the silicon oxide. An allowable amount of the impurities is preferably 30 mass % or less, and more preferably 10 mass % or less of the silica particles 15. Accordingly, inhibition of the effect due to the impurities is sufficiently reduced.

When the silica particles 15 contain the silicon oxide, the silicon oxide may be crystalline, and is preferably amorphous. So-called amorphous silica is distributed under names of colloidal silica, fumed silica, or the like, and has a stable quality. Therefore, by using the silica particles 15 containing the amorphous silica, it is possible to form the bonding portion 13 containing few coarse particles. As a result, the thixotropic molding material 10 that enables stable thixotropic molding is obtained.

As described above, it is sufficient that the average particle diameter of the silica particles 15 is smaller than the average particle diameter of the AlN particles 14. Specifically, the average particle diameter of the silica particles 15 is preferably 20% or less, more preferably 10% or less, and still more preferably 5% or less of the average particle diameter of the AlN particles 14. Accordingly, the silica particles 15 are particularly likely to enter between the metal body 11 and the AlN particles 14 and between the AlN particles 14. The specific surface area of the silica particles 15 is also particularly large.

The lower limit value may not necessarily be set, and is preferably 0.01% or more, more preferably 0.05% or more, and still more preferably 0.10% or more of the AlN particles 14 from the viewpoint of easy aggregation of the silica particles 15 and difficulty in handling of the silica particles 15.

The average particle diameter of the silica particles 15 is preferably 1 nm or more and 100 nm or less, more preferably 10 nm or more and 80 nm or less, and still more preferably 20 nm or more and 60 nm or less. When the average particle diameter is within the above range, the silica particles 15 are particularly likely to enter between the metal body 11 and the AlN particles 14 or between the AlN particles 14. The specific surface area of the silica particles 15 is also particularly large. Further, when the average particle diameter is within the above range, aggregation of the silica particles 15 is prevented.

The average particle diameter of the silica particles 15 is a value obtained by measuring an intermediate value between a length of a major axis and a length of a minor axis of the silica particles 15 as the particle diameter from an observation image of the silica particles 15 magnified and observed with a microscope and averaging 100 or more pieces of measurement data. As the microscope, for example, a scanning electron microscope or an optical microscope is preferably used.

An addition amount of the silica particles 15 is preferably 2.0 parts by mass or more and 20.0 parts by mass or less, and more preferably 3.0 parts by mass or more and 10.0 parts by mass or less, when the total mass of the metal body 11 and the AlN particles 14 is 100 parts by mass. By setting the addition amount of the silica particles 15 within the above range, it is possible to sufficiently secure a bonding function by the silica particles 15 and to prevent generation of the excess silica particles 15. When the addition amount of the silica particles 15 is less than the above lower limit value, the silica particles 15 are insufficient, and thus the AlN particles 14 may fall off from the metal body 11 depending on a surface state or the like of the metal body 11. On the other hand, when the addition amount of the silica particles 15 is more than the above upper limit value, the silica particles 15 are excessive, and thus the mechanical properties of the thixotropically molded product may decrease, or an effect due to the addition of the AlN particles 14 may decrease.

The silica particles 15 may be subjected to any surface treatment as necessary. Examples of the surface treatment include a plasma treatment, a corona treatment, an ozone treatment, an ultraviolet irradiation treatment, a roughening treatment, and a coupling agent treatment.

The bonding portion 13 may contain a substance other than the silica particles 15. In this case, a content of the substance other than the silica particles 15 may be less than the content of the silica particles 15 in terms of mass ratio, and is preferably 10 mass % or less, and more preferably 5 mass % or less of the silica particles 15.

Examples of the substance other than the silica particles 15 include an organic binder. The organic binder reinforces fixation of the AlN particles 14 by the silica particles 15 and enhances a bonding force of the bonding portion 13. In addition, by using the silica particles 15 and the organic binder in combination, it is possible to obtain the above-described effect while reducing an amount of the organic binder to be used.

Examples of the organic binders include various resins, waxes, alcohols, higher fatty acids, fatty acid metals, higher fatty acid esters, higher fatty acid amides, nonionic surfactants, and silicone-based lubricants. The various resins include: polyolefins such as a polyethylene, a polypropylene, and an ethylene-vinyl acetate copolymer; acrylic resins such as polymethyl methacrylate and polybutyl methacrylate; styrene-based resins such as a polystyrene; polyesters such polyvinyl chloride, polyvinylidene chloride, polyamide, polyethylene terephthalate, and polybutylene terephthalate; a polyether; polyvinyl alcohol; polyvinyl pyrolidone; or copolymers thereof. The organic binder may be a mixture containing at least one of the above components and another component, or may be a mixture containing two or more of the above components.

Among these, the organic binder preferably contains waxes, and more preferably contains a paraffin wax or a derivative thereof. The wax has good binding capacity.

Examples of the waxes include natural waxes and synthetic waxes. The natural waxes include: a plant wax such as a candelilla wax, a carnauba wax, a rice wax, a Japan wax, and jojoba oil; an animal wax such as a beeswax, lanolin, and spermaceti; a mineral wax such as a Montan wax, ozokerite, and ceresin; and a petroleum wax such as a paraffin wax, a microcrystalline wax, and petrolatum. The synthetic waxes include: a synthetic hydrocarbon such as a polyethylene wax, a modified wax such as Montan wax derivatives, paraffin wax derivatives, and microcrystalline wax derivatives; a hydrogenated wax such as hardened castor oil and hardened castor oil derivatives; a fatty acid such as 12-hydroxystearic acid; acid amide such as stearamide; and an ester such as phthalic anhydride ester.

2.4. Effects of First Embodiment

As described above, the thixotropic molding material 10 according to the first embodiment includes the metal body 11, the AlN particles 14, and the silica particles 15. The metal body 11 contains Mg as a main component. The AlN particles 14 adhere to the surface of the metal body 11, and contain AlN as a main component. The silica particles 15 are interposed between the metal body 11 and the AlN particles 14, have an average particle diameter smaller than the average particle diameter of the AlN particles 14, and contain a silicon oxide as a main component. Further, a mass fraction of the AlN particles 14 in a total mass of the metal body 11 and the AlN particles 14 is 3.0% or more and 30.0% or less.

In such a thixotropic molding material 10, the AlN particles 14 are less likely to fall off because the metal body 11 and the AlN particles 14 are more firmly fixed to each other via the silica particles 15. Therefore, when the thixotropic molding material 10 is charged into the heating cylinder 7 during the thixotropic molding, the semi-molten material of the metal body 11 and the AlN particles 14 are likely to be uniformly mixed. Accordingly, the AlN particles 14 and the silica particles 15 can be uniformly dispersed in the thixotropically molded product. As a result, a thixotropically molded having high mechanical strength derived from AlN in addition to high specific rigidity derived from Mg can be produced. In addition, the thixotropically molded product is also imparted with high thermal conductivity derived from AlN.

The silica particles 15 act to enhance the wettability between the AlN particles 14 and the semi-molten material of the metal body 11 during the thixotropic molding. As a result, it is possible to produce a thixotropically molded product which is denser and has enhanced mechanical strength and thermal conductivity.

When the AlN particles 14 are subjected to thermogravimetric analysis in which the temperature is increased from room temperature at a temperature increase rate of 10° C./min, a weight loss rate at 300° C. is preferably 0.3% or less.

Accordingly, the generation of gas during the thixotropic molding is sufficiently reduced. As a result, the thixotropic molding material 10 that enables stable thixotropic molding is obtained.

The content of the silica particles 15 is preferably 2.0 parts by mass or more and 20.0 parts by mass or less with respect to 100 parts by mass of the total mass of the metal body 11 and the AlN particles 14.

Accordingly, it is possible to sufficiently secure a bonding function by the silica particles 15 and to prevent generation of the excess silica particles 15.

3. Second Embodiment

Next, a method of producing the thixotropic molding material 10 according to a second embodiment will be described.

Figure 5:
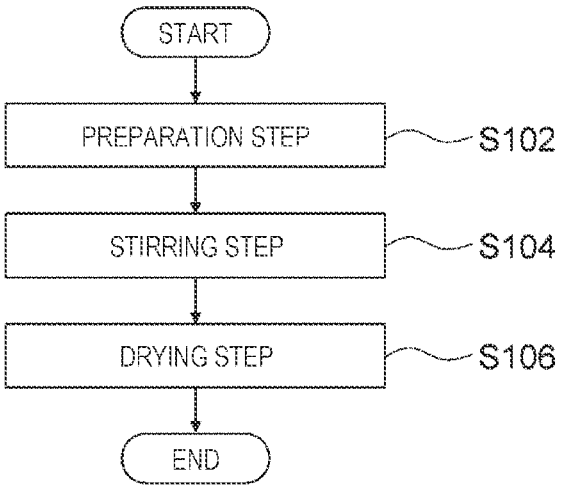
FIG. 5 is a step diagram showing a method of producing a thixotropic molding material.

FIG. 5 is a step diagram showing a method of producing the thixotropic molding material 10.

The method of producing the thixotropic molding material 10 shown in FIG. 5 includes a preparation step S102, a stirring step S104, and a drying step S106.

3.1. Preparation Step

In the preparation step S102, mixture containing the metal body 11, the AlN particles 14, the silica particles 15, and a dispersion medium is prepared. The mixture is a dispersion liquid in which the metal body 11, the AlN particles 14, and the silica particles 15 are dispersed using a sufficient amount of the dispersion medium.

The dispersion medium is not particularly limited as long as the dispersion medium does not modify the metal body 11, the AlN particles 14, and the silica particles 15. Examples of the dispersion medium include water, isopropyl alcohol, and acetone. In this step, a mixture produced in advance may be prepared. By containing water in the dispersion medium, it is possible to introduce hydroxy groups in a higher density to the surfaces of the metal body 11, the AlN particles 14, and the silica particles 15.

3.2. Stirring Step

In the stirring step S104, the mixture is stirred. For stirring, for example, a method of using a stirring rod or a stirring bar, or a method of shaking a container containing a mixture in a state of being covered with a lid is used. By such stirring, the AlN particles 14 can adhere to the surface of the metal body 11 via the silica particles 15. A part of the AlN particles 14 may directly adhere to the surface of the metal body 11 without the silica particles 15 interposed therebetween. At this stage, the AlN particles 14 may adhere to the surface of the metal body 11 with a weak adhesive force.

In addition, by stirring, aggregation of the metal body 11, aggregation of the AlN particles 14, and aggregation of the silica particles 15 can be prevented.

3.3. Drying Step

In the drying step S106, the mixture is dried. Accordingly, the AlN particles 14 adhering to the surface of the metal body 11 via the silica particles 15 adhere to the metal body 11 more firmly. For example, when hydroxy groups present on the surfaces of the silica particles 15 and hydroxy groups present on the surfaces of the metal body 11 or the AlN particles 14 are bonded to each other by a weak adhesive force due to a hydrogen bond or the like, dehydration shrinkage occurs through this step, and the AlN particles 14 and the metal body 11 are bonded to each other by a stronger adhesive force. For example, silanol groups are present on the surfaces of the silica particles 15. Through this step, the dehydration shrinkage occurs in the silanol groups, siloxane bonds are generated between the silica particles 15, and the silica particles 15 act like an adhesive. In this way, the AlN particles 14 are fixed to the metal body 11. When an organic binder is added to the mixture, the organic binder is melted by heating in the drying step S106 and solidified, and fixation of the AlN particles 14 is reinforced.

In addition, the dispersion medium contained in the thixotropic molding material 10 can be sufficiently removed. Accordingly, a vaporized component is sufficiently removed, and the thixotropic molding material 10 capable of preventing occurrence of molding defects due to vaporization is obtained. According to such a thixotropic molding material 10, it is possible to produce a thixotropically molded product which is dense and is excellent in mechanical strength.

For drying, a method of heating the mixture, a method of exposing the mixture to a gas, or the like is used. Among these, in the case of heating the mixture, for example, the entire container containing the mixture may be heated using a hot bath or the like. In the drying step S106, all the dispersion medium in the mixture may be removed, or a part of the dispersion medium may remain without being removed.

As described above, the thixotropic molding material 10 is obtained. When the mixture contains an organic binder, a degreasing treatment may be performed on the thixotropic molding material 10 after the drying step S106.

3.4. Effects of Second Embodiment

As described above, the method of producing the thixotropic molding material according to the embodiment includes the preparation step S102, the stirring step S104, and the drying step S106. In the preparation step S102, a mixture containing the metal body 11 containing Mg as a main component, the AlN particles 14 containing AlN, the silica particles 15, and a dispersion medium is prepared. In the stirring step S104, the mixture is stirred. In the drying step S106, the AlN particles 14 adhere to the surface of the metal body 11 via the silica particles 15 by removing at least a part of the dispersion medium from the stirred mixture.

According to such a production method, since the metal body 11 and the AlN particles 14 are more firmly fixed to each other via the silica particles 15, it is possible to produce the thixotropic molding material 10 in which the AlN particles 14 are less likely to fall off. In such a thixotropic molding material 10, the AlN particles 14 and the silica particles 15 can be uniformly dispersed during the thixotropic molding. As a result, it is possible to produce the thixotropic molding material 10 with which a thixotropically molded product having high mechanical strength derived from AlN in addition to high specific rigidity derived from Mg can be produced.

In addition, the AlN particles 14 are preferably particles produced by an alumina reduction nitriding method. The AlN particles 14 produced by the method have a small change in weight when heated as compared with powders produced by other production methods, thereby enabling stable thixotropic molding. Therefore, by using the thixotropic molding material 10 containing such AlN particles 14, a dense thixotropically molded product can be produced.

The silica particles 15 are particles containing amorphous silica. Such silica particles 15 have few coarse particles. Therefore, the thixotropic molding material 10 that enables stable thixotropic molding is obtained.

4. Third Embodiment

Next, a thixotropically molded product according to a third embodiment will be described.

Figure 6:
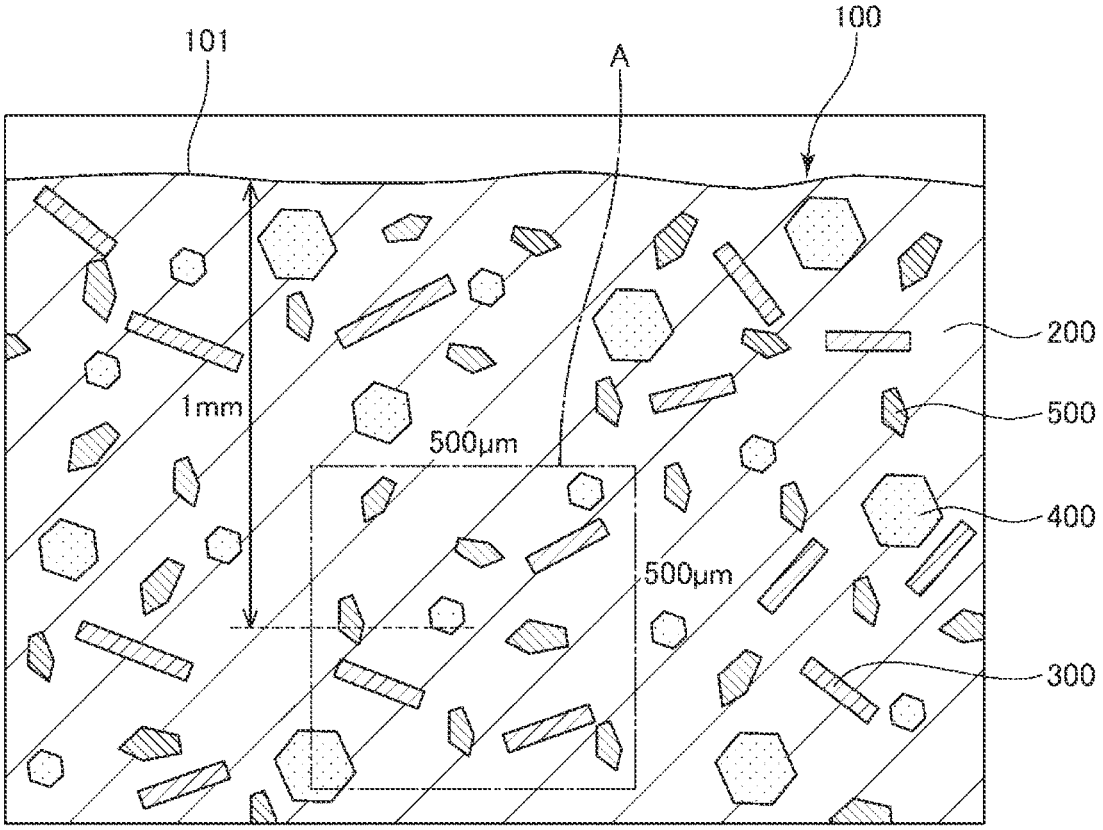
FIG. 6 is a partial cross-sectional view schematically showing a thixotropically molded product according to a third embodiment.

FIG. 6 is a partial cross-sectional view schematically showing a thixotropically molded product 100 according to the third embodiment.

The thixotropically molded product 100 shown in FIG. 6 has a matrix portion 200, and first particle portions 300, second particle portions 400, and third particle portions 500 dispersed in the matrix portion 200. Shapes, sizes, and distributions of the first particle portion 300, the second particle portion 400, and the third particle portion 500 shown in FIG. 6 do not necessarily indicate actual shapes, sizes, and distributions, but are schematic.

The matrix portion 200 contains Mg as a main component. The first particle portions 300 contain AlN as a main component. The second particle portions 400 contain $Mg_2Si$ as a main component. The third particle portions 500 contain MgO as a main component. Further, an area fraction S1 of the first particle portions 300 in the cross section of the thixotropically molded product 100 is 1.6% or more and 18.1% or less.

Such a thixotropically molded product 100 has high mechanical strength derived from the first particle portions 300 in addition to high specific rigidity derived from the matrix portion 200. The thixotropically molded product 100 is also provided with high thermal conductivity and a high elastic modulus derived from the first particle portions 300. Further, the second particle portions 400 and the third particle portions 500 function as a reinforcing material for enhancing the rigidity of the thixotropically molded product 100. In addition, at least a part of the second particle portions 400 and the third particle portions 500 are distributed to be adjacent to the first particle portions 300. Accordingly, the second particle portions 400 and the third particle portions 500 contribute to enhancing wettability between the first particle portions 300 and the matrix portion 200. As a result, the thixotropically molded product 100 is dense and has high mechanical strength and thermal conductivity. Such a thixotropically molded product 100 is suitably used for, for example, a member for which heat dissipation and high rigidity or high strength are required.

4.1. Matrix Portion

The matrix portion 200 contains Mg as a main component. Containing Mg as a main component refers to that, when elemental analysis is performed on a cross section of the matrix portion 200, a content of Mg is the highest in terms of atomic ratio. For the elemental analysis, for example, a qualitative and quantitative analysis based on an energy dispersive X-ray spectroscopy (EDX) is used. The content of Mg in the matrix portion 200 may be higher than that of other elements, and is preferably more than 50 atomic %, more preferably 70 atomic % or more, and still more preferably 80 atomic % or more. During identification of the matrix portion 200 in the qualitative and quantitative analysis, the matrix portion 200 can be distinguished based on a contrast with other sites or a color tone in, for example, an observation image from a scanning electron microscope or an optical microscope. The matrix portion 200 may contain additives or impurities other than Mg.

The matrix portion 200 occupies the highest area fraction in the cross section of the thixotropically molded product 100. Therefore, the matrix portion 200 has a dominant influence on the mechanical properties and thermal properties of the thixotropically molded product 100. Accordingly, high specific rigidity and high specific strength of Mg are reflected in the thixotropically molded product 100.

The matrix portion 200 is a site derived from the metal body 11, for example, when the matrix portion 200 is produced using the above-described thixotropic molding material 10. In this case, the matrix portion 200 is a site having a composition substantially the same as that of the metal body 11.

4.2. First Particle Portion (AlN)

The first particle portions 300 contain AlN as a main component. Containing AlN as a main component refers to that, when the elemental analysis is performed on the first particle portions 300, a content of one of Al and N is the highest and a content of the other is the second highest in terms of atomic ratio. For the elemental analysis, for example, a qualitative and quantitative analysis based on an energy dispersive X-ray spectroscopy (EDX) is used. A total content of Al and N in the first particle portions 300 may be higher than that of other elements, and is preferably more than 50 atomic %, and more preferably 60 atomic % or more. During the identification of the first particle portions 300 in the qualitative and quantitative analysis, the first particle portions 300 can be distinguished based on a contrast with other sites or a color tone in, for example, an observation image from a scanning electron microscope or an optical microscope. The first particle portions 300 may contain additives or impurities other than AlN.

In the observation image of the cross section of the thixotropically molded product 100 shown in FIG. 6, a range A of 500 μm square is set around a point at a depth of 1 mm from a surface 101. A proportion of an area of the first particle portions 300 to an area of the range A is defined as the area fraction S1 of the first particle portions 300.

At this time, the area fraction S1 is 1.6% or more and 18.1% or less as described above. By setting the area fraction S1 within the above range, the above-described effect by the first particle portions 300, specifically, the effect of enhancing the mechanical strength of the thixotropically molded product 100 in addition to the high specific rigidity derived from Mg can be obtained. In addition, the thixotropically molded product 100 is provided with high thermal conductivity and high rigidity derived from AlN. Therefore, when the area fraction S1 is less than the above lower limit value, the first particle portions 300 are insufficient, and thus the above-described effect cannot be obtained. On the other hand, when the area fraction S1 is more than the above upper limit value, the first particle portions 300 are excessive, and the rigidity of the matrix portion 200 decreases, and as a result, the rigidity of the thixotropically molded product 100 decreases. The area fraction S1 is preferably 2.6% or more and 14.7% or less, and more preferably 3.7% or more and 11.4% or less.

The area fraction S1 in the range A is calculated as follows. First, a range of the first particle portions 300 is extracted by image processing in the range A. For the image processing, for example, image analysis software OLYMPUS Stream or the like can be used. A magnification of the observation image is preferably 300 times or more. Next, a proportion of the area of the first particle portion 300 to the entire area of the range A is calculated. The proportion is defined as the area fraction S1.

4.3. Second Particle Portion ($Mg_2Si$)

The second particle portions 400 contain $Mg_2Si$ as a main component, and have a particulate shape. $Mg_2Si$ has a tensile elastic modulus (Young's modulus) higher than that of the matrix portion 200. Therefore, the second particle portions 400 function as a reinforcing material for enhancing the rigidity of the thixotropically molded product 100. Accordingly, the thixotropically molded product 100 has higher rigidity.

Containing $Mg_2Si$ as a main component refers to that, when elemental analysis is performed on cross sections of the second particle portions 400, a content of Mg is the highest and a content of Si is the second highest in terms of atomic ratio. For the elemental analysis, for example, a qualitative and quantitative analysis based on an energy dispersive X-ray spectroscopy (EDX) is used. A total content of Mg and Si in the second particle portions 400 may be higher than that of other elements, and is preferably more than 50 atomic %, and more preferably 60 atomic % or more. During the identification of the second particle portions 400 in the qualitative and quantitative analysis, the second particle portions 400 can be distinguished based on a contrast with the matrix portion 200 and other sites or a color tone in, for example, an observation image from a scanning electron microscope or an optical microscope. The second particle portions 400 may contain additives or impurities other than $Mg_2Si$.

The second particle portions 400 also have a function of preventing coarsening of Mg crystals contained in the matrix portion 200. Therefore, in the thixotropically molded product 100, refinement of the Mg crystals in the matrix portion 200 is achieved. Accordingly, the thixotropically molded product 100 has high mechanical strength.

A cross-sectional shape of the second particle portion 400 is not particularly limited and may be any shape, and an average aspect ratio thereof is preferably less than 2.0, and more preferably 1.5 or less. Accordingly, the second particle portions 400 are less likely to become a starting point that causes a crack in the thixotropically molded product 100, and thus an effect of enhancing the mechanical strength of the thixotropically molded product 100 is obtained. In addition, the effect of preventing coarsening of the Mg crystals is more remarkable.

An aspect ratio of the second particle portions 400 is a ratio of a length to a width of the second particle portions 400 in the cross section of the thixotropically molded product 100. The length is a maximum length that can be taken in a cross section of the second particle portion 400, and the width is a maximum length in a direction orthogonal to a direction of the maximum length. Then, ten second particle portions 400 are randomly extracted from f the the observation image of the cross section of thixotropically molded product 100, and an average value of the aspect ratios of the second particle portions is the average aspect ratio. For example, an optical microscope or an electron microscope is used to acquire the observation image.

In addition, as described above, the second particle portions 400 also contribute to enhancing the wettability between the first particle portions 300 and the matrix portion 200. Therefore, at least a part of the second particle portions 400 are preferably adjacent to the first particle portions 300. Accordingly, voids and the like are less likely to be generated between the first particle portions 300 and the matrix portion 200, and the thixotropically molded product 100 can be made denser.

4.4. Third Particle Portion (MgO)

The third particle portions 500 contain MgO as a main component, and have a particulate shape. MgO has a tensile elastic modulus (Young's modulus) higher than that of the matrix portion 200. Therefore, the third particle portions 500 function as a reinforcing material for enhancing the rigidity of the thixotropically molded product 100. Accordingly, the thixotropically molded product 100 has higher rigidity.

Containing MgO as a main component refers to that, when elemental analysis is performed on cross sections of the third particle portions 500, a content of one of Mg and O is the highest and a content of the other is the second highest in terms of atomic ratio. For the elemental analysis, for example, a qualitative and quantitative analysis based on an energy dispersive X-ray spectroscopy (EDX) is used. A total content of Mg and O in the third particle portions 500 may be higher than that of other elements, and is preferably more than 50 atomic %, and more preferably 60 atomic % or more. During the identification of the third particle portions 500 in the qualitative and quantitative analysis, the third particle portions 500 can be distinguished based on a contrast with the matrix portion 200 and other sites or a color tone in, for example, an observation image from a scanning electron microscope or an optical microscope. The third particle portions 500 may contain additives or impurities other than MgO.

In addition, the third particle portions 500 have a function of preventing coarsening of the Mg crystals contained in the matrix portion 200. Therefore, in the thixotropically molded product 100, refinement of the Mg crystals in the matrix portion 200 is achieved. Accordingly, the thixotropically molded product 100 has high mechanical strength.

Further, the third particle portions 500 also have a function of inhibiting abnormal growth of the second particle portion 400 in a branch shape or a needle shape. Due to the function, the second particle portion 400 tends to have an isotropic shape, and an increase in the average aspect ratio is prevented.

In addition, as described above, the third particle portions 500 also contribute to enhancing the wettability between the first particle portions 300 and the matrix portion 200. Therefore, at least a part of the third particle portions 500 are preferably adjacent to the first particle portions 300. Accordingly, voids and the like are less likely to be generated between the first particle portions 300 and the matrix portion 200, and the thixotropically molded product 100 can be made denser.

4.5. Area Fraction of Each Portion

In the cross section of the thixotropically molded product 100, an area fraction of the second particle portions 400 is defined as S2, and an area fraction of the third particle portions 500 is defined as S3. In this case, a total area fraction S1+S2+S3 of the first particle portions 300, the second particle portions 400, and the third particle portions 500 is preferably 3.0% or more and 50.0% or less, more preferably 4.0% or more and 45.0% or less, and still more preferably 5.0% or more and 40.0% or less. By setting the total area fraction S1+S2+S3 within the above range, the rigidity, the mechanical strength, and the thermal conductivity of the thixotropically molded product 100 can be further enhanced without impairing the high specific rigidity derived from Mg of the thixotropically molded product 100.

4.6. X-ray Diffraction

Next, a 2θ diffraction pattern obtained when crystal structure analysis by an X-ray diffraction method is performed on the thixotropically molded product 100 will be described. The 2θ diffraction pattern is a pattern created by plotting detection results of X-rays diffracted by the thixotropically molded product 100 when a horizontal axis is a diffraction angle 2θ and a vertical axis is a diffraction intensity.

Figure 7:
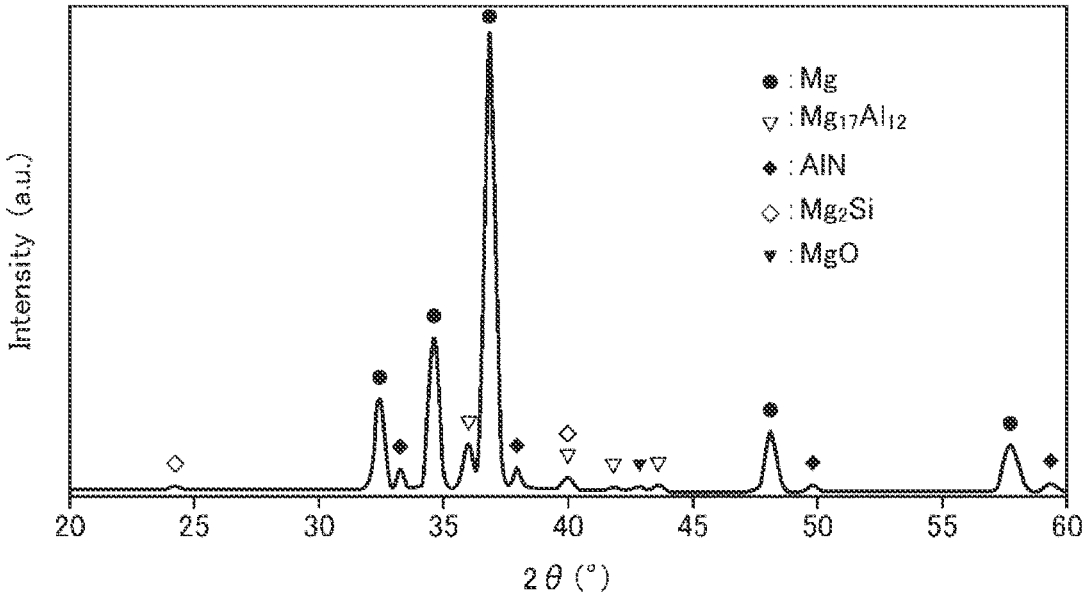
FIG. 7 is an example of a 2θ diffraction pattern obtained by performing crystal structure analysis by an X-ray diffraction method on the thixotropically molded product.
Figure 8:
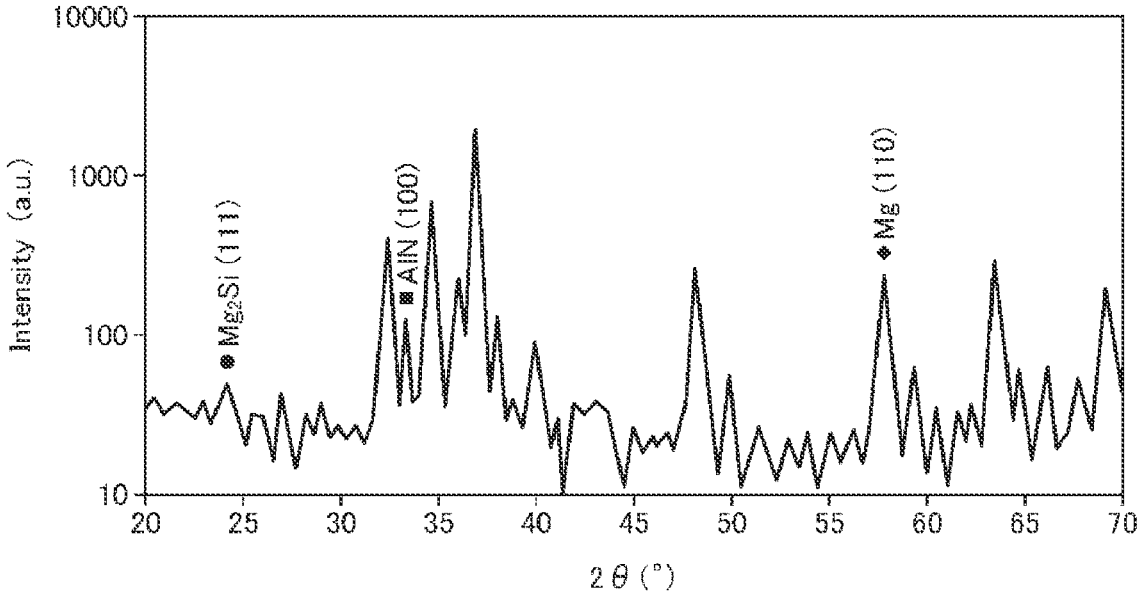
FIG. 8 is a partially enlarged view of FIG. 7.

FIG. 7 is an example of the 2θ diffraction pattern obtained by performing the crystal structure analysis by the X-ray diffraction method on the thixotropically molded product 100. In addition, FIG. 8 is a partially enlarged view of FIG. 7. In FIGS. 7 and 8, the vertical axis is a logarithmic axis.

The 2θ diffraction pattern shown in FIGS. 7 and 8 has an AlN peak assigned to a (100) plane of AlN and an $Mg_2Si$ peak assigned to a (111) plane of $Mg_2Si$. The AlN peak is a peak due to the first particle portions 300 described above, and the $Mg_2Si$ peak is a peak due to the second particle portions 400 described above.

In the 2θ diffraction pattern, the AlN peak is located near a diffraction angle 2θ of 33° to 34°, and the $Mg_2Si$ peak is located near a diffraction angle 2θ of 24° to 25°. Here, a peak intensity of the AlN peak is defined as I(AlN), and a peak intensity of the $Mg_2Si$ peak is defined as $I(Mg_2Si)$. The 2θ diffraction pattern obtained from the thixotropically molded product 100 preferably satisfies $I(AlN)>I(Mg_2Si)$. Accordingly, a quantitative balance between the first particle portions 300 and the second particle portions 400 is improved. That is, the thixotropically molded product 100 can be obtained in which the effects of the first particle portions 300 can be fully obtained while preventing the ratio occupied by the second particle portions 400 from becoming too large.

The peak intensity refers to a height from a background to a peak top of the 2θ diffraction pattern.

The peak intensity I(AlN) is preferably 1.1 times or more, more preferably 2.0 times or more and 100.0 times or less, and still more preferably 3.0 times or more and 50.0 times or less the peak intensity $I(Mg_2Si)$. Accordingly, both the effect of the first particle portions 300 and the effect of the second particle portions 400 can be achieved at a higher level. As a result, the thixotropically molded product 100 having particularly good rigidity, mechanical strength, and thermal conductivity can be implemented.

The 2θ diffraction patterns shown in FIGS. 7 and 8 further have an Mg peak assigned to a (110) plane of Mg. The Mg peak is a peak due to the matrix portion 200 described above.

In the 2θ diffraction pattern, the Mg peak is located near a diffraction angle 2θ of 57° to 59°. Here, a peak intensity of the Mg peak is defined as I(Mg). The 2θ diffraction pattern obtained from the thixotropically molded product 100 preferably satisfies I(Mg)>I(AlN). Accordingly, a quantitative balance between the first particle portions 300 and the matrix portion 200 is improved. That is, the thixotropically molded product 100 can be obtained in which the high specific rigidity and the like derived from the matrix portion 200 are maintained while preventing the ratio occupied by the first particle portions 300 from becoming too large.

The peak intensity I(Mg) is preferably 1.1 times or more, more preferably 2.0 times or more and 50.0 times or less, and still more preferably 3.0 times or more and 20.0 times or less the peak intensity I(AlN). Accordingly, both the effect of the matrix portion 200 and the effect of the first particle portions 300 can be achieved at a higher level. As a result, the thixotropically molded product 100 having particularly good rigidity, mechanical strength, and thermal conductivity can be implemented.

4.7. Physical Properties of Thixotropically Molded Product

A tensile elastic modulus (Young's modulus) of the thixotropically molded product 100 is preferably 45 GPa or more, and more preferably 48 GPa or more. The thixotropically molded product 100 having a tensile elastic modulus within the above range has particularly high specific rigidity. Since such a thixotropically molded product 100 is lightweight and has high rigidity, the thixotropically molded product 100 is suitable for, for example, a component used for a transportation device such as an automobile and an aircraft, a component used in a mobile device such as a mobile terminal and a notebook computer, and a movable component such as a robot arm.

The tensile elastic modulus of the thixotropically molded product 100 is measured as follows. First, a test piece is cut out from the thixotropically molded product 100. Next, the test piece is attached to a tensile tester, and a tensile load is applied to the test piece at 25° C. Next, an amount of change in tensile strain when the tensile load is varied and an amount of change in tensile stress when the tensile load is varied are calculated. Then, a ratio of the latter amount of change to the former amount of change is calculated, and the obtained ratio is defined as the tensile elastic modulus of the thixotropically molded product 100. The tensile elastic modulus of the thixotropically molded product 100 may be a value measured by a method other than the above-described measurement method, for example, a resonance method or an ultrasonic pulse method.

The tensile strength of the thixotropically molded product 100 is preferably 180 MPa or more, and more preferably 190 MPa or more. Further, a 0.2% proof stress of the thixotropically molded product 100 is preferably 155 MPa or more, and more preferably 165 MPa or more.

The thixotropically molded product 100 in which the tensile strength and the 0.2% proof stress are within the above ranges has particularly high specific strength. Since such a thixotropically molded product 100 is lightweight and has high strength, the thixotropically molded product 100 is suitable for, for example, a component used for a transportation device such as an automobile and an aircraft, a component used in a mobile device such as a mobile terminal and a notebook computer, and a movable component such as a robot arm.

The tensile strength and the 0.2% proof stress of the thixotropically molded product 100 are measured as follows. First, a test piece is cut out from the thixotropically molded product 100. Examples of the test piece include a No. 13 test piece defined in JIS. Next, the test piece is attached to a tensile tester, and a stress corresponding to a maximum force applied to the test piece at 25° C. is calculated. The obtained stress is defined as the tensile strength of the thixotropically molded product 100. In addition, in a stress-strain curve obtained by measurement, a stress corresponding to a point of 0.2% strain is defined as the 0.2% proof stress.

Vickers hardness of a surface of the thixotropically molded product 100 is preferably 65 or more, more preferably 70 or more, and still more preferably 80 or more. When the Vickers hardness is within the above range, it is possible to obtain the thixotropically molded product 100 having high surface hardness and being resistant to scratches and the like. The Vickers hardness of the surface of the thixotropically molded product 100 is measured according to a Vickers hardness test method defined in JIS Z 2244:2009. A measurement load is 5 kgf.

A thermal conductivity of the thixotropically molded product 100 is preferably 51 W/(m·K) or more, more preferably 52 W/(m·K) or more, and still more preferably 53 W/(m·K) or more. The thixotropically molded product 100 having such a thermal conductivity can also be applied to, for example, a site where heat dissipation is required.

The thermal conductivity of the thixotropically molded product 100 is measured by, for example, a laser flash method.

A linear expansion coefficient of the thixotropically molded product 100 is preferably $26\times10^{-6}$/K or less, more preferably $24\times10^{-6}$/K or less, and still more preferably $22\times10^{-6}$/K or less. Since the thixotropically molded product 100 having such a linear expansion coefficient has a linear expansion coefficient lower than that of Mg alone, a dimensional change due to a temperature change is small.

The linear expansion coefficient of the thixotropically molded product 100 is measured according to, for example, a method of measuring a linear expansion coefficient of a metal material defined in JIS Z 2285:2003.

In addition, an electrical conductivity of the thixotropically molded product 100 is preferably 11% IACS or less, more preferably 10% IACS or less, and still more preferably 9% IACS or less. Such a thixotropically molded product 100 has a relatively low electrical conductivity among metal materials. Therefore, an induced current caused by, for example, electromagnetic induction is less likely to flow, and thus the thixotropically molded product 100 is suitable for a member used in a site where a change in magnetic field occurs, such as a motor case.

The electrical conductivity of the thixotropically molded product 100 is measured according to, for example, a volume resistivity and conductivity measurement method of a nonferrous metal material defined in JIS H 0505:1975.

4.8. Effects of Third Embodiment

As described above, the thixotropically molded product 100 according to the third embodiment includes the matrix portion 200, the first particle portions 300, the second particle portions 400, and the third particle portions 500. The matrix portion 200 contains Mg as a main component. The first particle portions 300 are dispersed in the matrix portion 200 and contain AlN as a main component. The second particle portions 400 are dispersed in the matrix portion 200 and contain $Mg_2Si$ as a main component. The third particle portions 500 are dispersed in the matrix portion 200 and contain MgO as a main component. Further, the area fraction S1 of the first particle portions 300 in a cross section of the thixotropically molded product 100 is 1.6% or more and 18.1% or less.

According to such a configuration, the high mechanical strength of the first particle portions 300 can be added in addition to the high specific rigidity of the matrix portion 200. That is, the thixotropically molded product 100 having high mechanical strength is obtained. In addition, the second particle portions 400 and the third particle portions 500 contribute to enhancing the wettability between the first particle portions 300 and the matrix portion 200. As a result, the thixotropically molded product 100 is dense and has high mechanical strength and thermal conductivity.

The total area fraction S1+S2+S3 of the first particle portions 300, the second particle portions 400, and the third particle portions 500 in the cross-section of the thixotropically molded product 100 is preferably 3.0% or more and 50.0% or less.

Accordingly, the rigidity, the mechanical strength, and the thermal conductivity of the thixotropically molded product 100 can be further enhanced without impairing the high specific rigidity derived from Mg of the thixotropically molded product 100.

In addition, when a 2θ diffraction pattern of the thixotropically molded product 100 is obtained by X-ray diffraction, the obtained 2θ diffraction pattern has an AlN peak assigned to a (100) plane of AlN and an $Mg_2Si$ peak assigned to a (111) plane of $Mg_2Si$. Further, the 2θ diffraction pattern preferably satisfies $I(AN)>I(Mg_2Si)$, where I(AlN) is an intensity of the AlN peak and $I(Mg_2Si)$ is an intensity of the $Mg_2Si$ peak.

In the thixotropically molded product 100 from which such a 2θ diffraction pattern is obtained, a quantitative balance between the first particle portions 300 and the second particle portions 400 is improved. That is, the thixotropically molded product 100 can be obtained in which the effects of the first particle portions 300 can be fully obtained while preventing the ratio occupied by the second particle portions 400 from becoming too large.

In addition, when a 2θ diffraction pattern of the thixotropically molded product 100 is obtained by X-ray diffraction, the obtained 2θ diffraction pattern has an Mg peak assigned to a (110) plane of Mg and an AlN peak assigned to a (100) plane of AlN. Further, the 2θ diffraction pattern preferably satisfies I(Mg)>I(AlN), where I(Mg) is an intensity of the Mg peak and I(AlN) is an intensity of the AlN peak.

In the thixotropically molded product 100 from which such a 2θ diffraction pattern is obtained, a quantitative balance between the first particle portions 300 and the matrix portion 200 is improved. That is, the thixotropically molded product 100 can be obtained in which the high specific rigidity and the like derived from the matrix portion 200 are maintained while preventing the ratio occupied by the first particle portions 300 from becoming too large.

In addition, the thixotropically molded product 100 preferably has a tensile elastic modulus of 45 GPa or more, tensile strength of 180 MPa or more, and a thermal conductivity of 51 W/(m·K) or more.

Such a thixotropically molded product 100 has particularly good rigidity, mechanical strength, and thermal conductivity. Therefore, the thixotropically molded product 100 is suitably used for, for example, a member for which heat dissipation and high rigidity or high strength are required.

The thixotropic molding material, the method of producing the thixotropic molding material, and the thixotropically molded product according to the present disclosure are described above based on the shown embodiments, and the present disclosure is not limited to the above-described embodiments. For example, the thixotropic molding material and the thixotropically molded product according to the present disclosure may be those obtained by adding any components to the above-described embodiments.

Examples

Next, specific Examples of the present disclosure will be described.

5. Production of Thixotropically Molded Product

5.1. Sample No. 1

First, a magnesium alloy chip as a metal body, an aluminum nitride powder as AlN particles, silicon oxide particles as silica particles, and IPA (isopropyl alcohol) as a dispersion medium were mixed to obtain a mixture. A chip of 4 mm×2 mm×1 mm made of an AZ91D alloy manufactured by Nippon Materials Co., Ltd. was used as the magnesium alloy chip. The AZ91D alloy is an Mg-based alloy containing 9 mass % of Al and 1 mass % of Zn. Colloidal silica (amorphous silica particles) obtained by colloidal dispersion in IPA was used as the silicon oxide particles.

Production conditions for other thixotropic molding materials are as shown in Table 1.

Next, the mixture was stirred. A method of shaking a container containing the mixture was used for stirring.

Next, the stirred mixture was heated and dried. Accordingly, a thixotropic molding material was obtained.

Next, the obtained thixotropic molding material was charged into an injection molding machine and subjected to the thixotropic molding to obtain a thixotropically molded product of Sample No. 1. As the injection molding machine, a magnesium injection molding machine JLM75MG manufactured by The JAPAN STEEL WORKS, LTD. was used.

Production conditions for other thixotropically molded product are as shown in Table 3.

5.2. Sample Nos. 2 to 9

Thixotropically molded products of sample Nos. 2 to 9 were obtained in the same manner as in the case of sample No. 1 except that the production conditions for the thixotropic molding material and the production conditions for the thixotropically molded product were changed as shown in Tables 1 and 3.

5.3. Sample No. 10

A thixotropically molded product of sample No. 10 was obtained in the same manner as in sample No. 5 except that a paraffin wax as an organic binder was added instead of the silica particles. An addition ratio of the organic binder to the metal body was set to 0.3 mass %.

5.4. Sample Nos. 11 to 15

Thixotropically molded products of sample Nos. 11 to 15 were obtained in the same manner as in the case of sample No. 1 except that the production conditions for the thixotropic molding material and the production conditions for the thixotropically molded product were changed as shown in Tables 2 and 4.

TABLE 1

| | | Production condition for thixotropic molding material | | | | |
|---|---|---|---|---|---|---|
| | | AIN particles | | Silica particles | | |
| Sample No. | Example/ Comparative Example | Average particle diameter μm | Addition amount mass % | Average particle diameter nm | Particle diameter ratio % | Addition amount Parts by mass |
| 1 | Comparative Example | 5 | 0 | 45 | 0.90 | 5.0 |
| 2 | Comparative Example | 5 | 1 | 45 | 0.90 | 5.0 |
| 3 | Example | 5 | 3 | 45 | 0.90 | 5.0 |
| 4 | Example | 5 | 5 | 45 | 0.90 | 5.0 |
| 5 | Example | 5 | 10 | 45 | 0.90 | 5.0 |
| 6 | Example | 5 | 20 | 45 | 0.90 | 5.0 |
| 7 | Example | 5 | 25 | 45 | 0.90 | 5.0 |
| 8 | Example | 5 | 30 | 45 | 0.90 | 5.0 |
| 9 | Comparative Example | 5 | 40 | 45 | 0.90 | 5.0 |
| 10 | Comparative Example | 5 | 10 | — | — | — |

TABLE 2

| | | Production condition for thixotropic molding material | | | | |
|---|---|---|---|---|---|---|
| | | AIN particles | | Silica particles | | |
| Sample No. | Example/ Comparative Example | Average particle diameter μm | Addition amount mass % | Average particle diameter nm | Particle diameter ratio % | Addition amount Parts by mass |
| 11 | Example | 7 | 10 | 45 | 0.64 | 5.0 |
| 12 | Example | 15 | 10 | 45 | 0.30 | 5.0 |
| 13 | Example | 25 | 10 | 45 | 0.18 | 5.0 |
| 14 | Example | 5 | 10 | 20 | 0.40 | 5.0 |
| 15 | Example | 15 | 10 | 20 | 0.13 | 5.0 |

In Tables 1 to 4, among the thixotropically molded products of respective sample Nos., those corresponding to the present disclosure are indicated by "Examples", and those not corresponding to the present disclosure are indicated by "Comparative Examples".

6. Analysis Result of Thixotropically Molded Product

The thixotropically molded product of each sample No. was cut, and a cut surface was observed with an optical microscope. Then, the matrix portion, the first particle portions, the second particle portions, and the third particle portions were identified from the observation image.

Next, the area fraction S1 of the first particle portions, fraction S2 of the second particle portions, and the area fraction S3 of the third particle portions were calculated. Then, S1 and S1+S2+S3 were calculated. Calculation results are shown in Tables 3 and 4.

In addition, a 2θ diffraction pattern was obtained for the thixotropically molded product of each sample No. by an X-ray diffraction (XRD) method. Then, I(AlN)/I($Mg_2Si$) and I(Mg)/I(AlN) were calculated as XRD peak intensity ratios. Calculation results are shown in Tables 3 and 4.

7. Evaluation Results of Thixotropically Molded Product

Tensile strength, a tensile elastic modulus (Young's modulus), a thermal conductivity, a linear expansion coefficient, and an electrical conductivity were measured for the thixotropically molded product of each sample No. Measurement results are shown in Tables 3 and 4.

TABLE 3

| | | Production condition for thixotropically molded product | | | | Evaluation result of thixotropically molded product | | | | |
|---|---|---|---|---|---|---|---|---|---|---|
| | | Area fraction | | XRD peak Intensity ratio | | | | | | |
| Sample No. | Example/ Comparative Example | First particle portion S1 % | Total of particle portions S1 + S2 + S3 % | I(AlN)/ I($Mg_2Si$) time(s) | I(Mg)/I(AlN) time(s) | Tensile strength MPa | Tensile elastic modulus (Young's modulus) GPa | Thermal conductivity W/(m · K) | Linear expansion coefficient $\times 10^{-6}$/K | Electrical conductivity % IACS |
| 1 | Comparative Example | 0.0 | 20.0 | 0.0 | — | 170 | 40 | 50 | 27 | 11 |
| 2 | Comparative Example | 0.5 | 20.5 | 0.3 | 105 | 175 | 42 | 50 | 26 | 11 |
| 3 | Example | 1.6 | 21.6 | 1.2 | 15.0 | 190 | 45 | 51 | 25 | 10 |
| 4 | Example | 2.6 | 22.6 | 2.0 | 10.0 | 200 | 48 | 52 | 24 | 10 |
| 5 | Example | 5.4 | 25.4 | 3.0 | 4.5 | 200 | 49 | 52 | 23 | 9 |
| 6 | Example | 11.4 | 31.4 | 5.7 | 3.2 | 190 | 54 | 53 | 20 | 8 |
| 7 | Example | 14.7 | 34.7 | 7.3 | 2.5 | 185 | 56 | 55 | 19 | 5 |
| 8 | Example | 18.1 | 38.1 | 9.0 | 1.5 | 180 | 57 | 56 | 18 | 3 |
| 9 | Comparative Example | 25.6 | 45.6 | 12.8 | 0.7 | 160 | 60 | 60 | 17 | 2 |
| 10 | Comparative Example | 5.4 | 5.4 | — | 13.0 | 140 | 38 | 51 | 26 | 11 |

TABLE 4

| | | Production condition for thixotropically molded product | | | | Evaluation result of thixotropically molded product | | | | |
|---|---|---|---|---|---|---|---|---|---|---|
| | | Area fraction | | XRD peak intensity ratio | | | | | | |
| Sample No. | Example/ Comparative Example | First particle portion S1 % | Total of particle portions S1 + S2 + S3 % | I(AlN)/ I($Mg_2Si$) time(s) | I(Mg)/I(AlN) time(s) | Tensile strength MPa | Tensile elastic modulus (Young's modulus GPa | Thermal conductivity W/(m · K) | Linear expansion coefficient $\times 10^{-6}$/K | Electrical conductivity % IACS |
| 11 | Example | 5.4 | 25.4 | 3.0 | 4.8 | 210 | 50 | 52 | 23 | 9 |
| 12 | Example | 5.4 | 25.4 | 4.5 | 5.2 | 195 | 50 | 52 | 23 | 9 |
| 13 | Example | 5.4 | 25.4 | 4.6 | 6.1 | 190 | 49 | 51 | 24 | 10 |
| 14 | Example | 5.4 | 25.4 | 3.6 | 5.0 | 210 | 50 | 52 | 23 | 9 |
| 15 | Example | 5.4 | 25.4 | 5.4 | 4.5 | 195 | 50 | 52 | 23 | 9 |

As shown in Tables 3 and 4, it is found that the thixotropically molded product obtained in each Example has a tensile strength higher than the thixotropically molded product obtained in each Comparative Example. In addition, it is found that the thixotropically molded product obtained in each Example has a high tensile elastic modulus (Young's modulus) and a high thermal conductivity, and a low linear expansion coefficient and a low electrical conductivity.

In addition, it is found that the mechanical properties and the thermal properties can be enhanced by adding the silica particles together with the AlN particles in the production of the thixotropic molding material. It is presumed that this is because the silica particles prevent the falling off of the AlN particles and promote uniform dispersion of the AlN particles.

Figure 9:
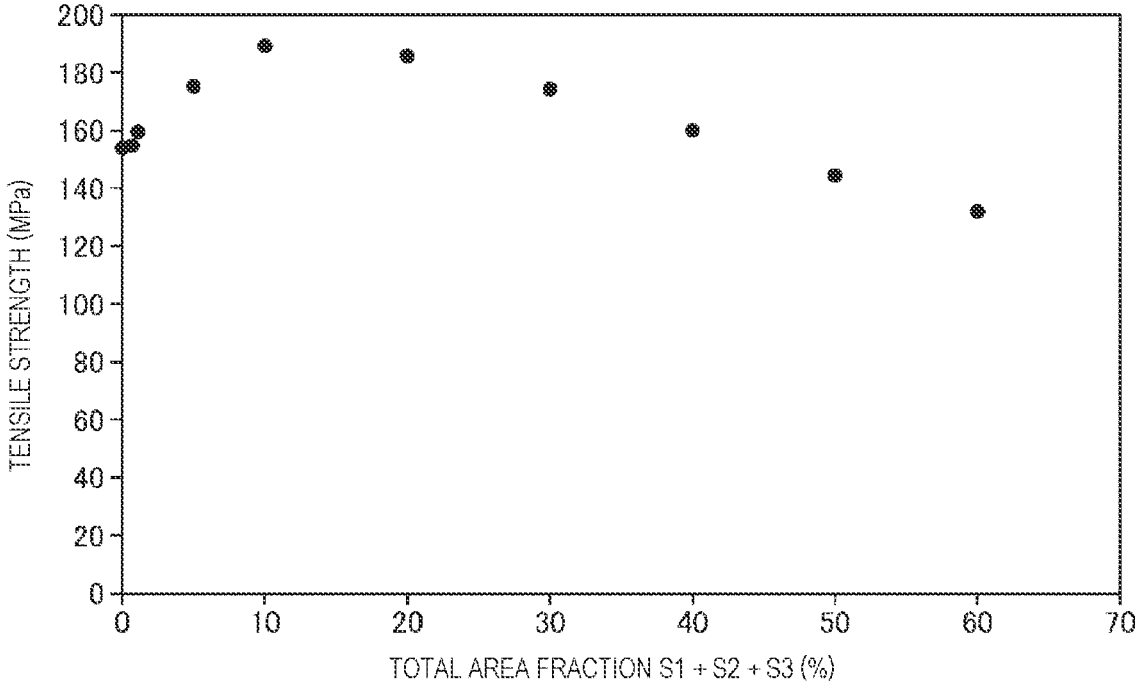
FIG. 9 is a graph showing a relationship between a total area fraction S1+S2+S3 and tensile strength.

Here, a thixotropically molded product in which the total area fraction S1+S2+S3 was changed from 0% to 60% was produced in the same manner as the above-described production method. A relationship between the total area fraction S1+S2+S3 and the tensile strength was determined. FIG. 9 is a graph showing the relationship between the total area fraction S1+S2+S3 and the tensile strength. As shown in FIG. 9, when the total area fraction S1+S2+S3 is changed from 0% to 60%, the tensile strength of the thixotropically molded product changes with a maximum value in the vicinity of 10% to 20%. When the tensile strength is 140 MPa or less, the thixotropically molded product is likely to be broken. Therefore, it is supported by the graph shown in FIG. 9 that an upper limit value of the total area fraction S1+S2+S3 is preferably 50.0.

What is claimed is:

1. A thixotropic molding material comprising:

a metal body containing Mg as a main component;

AlN particles adhering to a surface of the metal body and containing AlN as a main component; and silica particles interposed between the metal body and the AlN particles, having an average particle diameter smaller than an average particle diameter of the AlN particles, and containing a silicon oxide as a main component, wherein a mass fraction of the AlN particles in a total mass of the metal body and the AlN particles is 3.0% or more and 30.0% or less.

2. The thixotropic molding material according to claim 1, wherein the AlN particles have a weight loss rate at 300° C. of 0.3% or less when subjected to thermogravimetric analysis in which a temperature is increased from room temperature at a temperature increase rate of 10° C./min.

3. The thixotropic molding material according to claim 1, wherein a content of the silica particles is 2.0 parts by mass or more and 20.0 parts by mass or less with respect to 100 parts by mass of the total mass of the metal body and the AlN particles.

4. A method of producing a thixotropic molding material comprising:

a preparation step of preparing a mixture containing a metal body containing Mg as a main component, AlN particles containing AlN, silica particles, and a dispersion medium;

a stirring step of stirring the mixture; and a drying step of adhering the AlN particles to a surface of the metal body via the silica particles by removing at least a part of the dispersion medium from the stirred mixture.

5. The method of producing a thixotropic molding material according to claim 4, wherein the AlN particles are particles produced by an alumina reduction nitriding method.

6. The method of producing a thixotropic molding material according to claim 4, wherein the silica particles are particles containing amorphous silica.

7. A thixotropically molded product comprising:

a matrix portion containing Mg as a main component;

a first particle portion dispersed in the matrix portion and containing AlN as a main component;

a second particle portion dispersed in the matrix portion and containing $Mg_2Si$ as a main component; and a third particle portion dispersed in the matrix portion and containing MgO as a main component, wherein an area fraction of the first particle portion in a cross section is 1.6% or more and 18.1% or less.

8. The thixotropically molded product according to claim 7, wherein a total area fraction of the first particle portion, the second particle portion, and the third particle portion in the cross section is 3.0% or more and 50.0% or less.

9. The thixotropically molded product according to claim 7, wherein when a 2θ diffraction pattern is obtained by X-ray diffraction, the 2θ diffraction pattern has an AlN peak assigned to a (100) plane of AlN and an $Mg_2Si$ peak assigned to a (111) plane of $Mg_2Si$, and the 2θ diffraction pattern satisfies $I(AlN)>I(Mg_2Si)$, where I(AlN) is an intensity of the AlN peak, and $I(Mg_2Si)$ is an intensity of the $Mg_2Si$ peak.

10. The thixotropically molded product according to claim 7, wherein when a 2θ diffraction pattern is obtained by X-ray diffraction, the 2θ diffraction pattern has an Mg peak assigned to a (110) plane of Mg and an AlN peak assigned to a (100) plane of AlN, and the 2θ diffraction pattern satisfies I(Mg)>I(AlN), where I(Mg) is an intensity of the Mg peak, and I(AlN) is an intensity of the AlN peak.

11. The thixotropically molded product according to claim 7, wherein a tensile elastic modulus is 45 GPa or more, tensile strength is 180 MPa or more, and a thermal conductivity is 51 W/(m·K) or more.

* * * * *